US005952773A

United States Patent [19]

Manders et al.

[11] Patent Number: 5,952,773

[45] Date of Patent: Sep. 14, 1999

[54] CAPPED ELECTRIC LAMP

[75] Inventors: Wilhelmus J. M. Manders; Hendrikus A. M. Van Dulmen, both of Eindhoven, Netherlands

[73] Assignee: U.S. Philips Corporation, New York, N.Y.

[21] Appl. No.: 09/071,240

[22] Filed: May 1, 1998

[30] Foreign Application Priority Data

May 6, 1997 [EP] European Pat. Off. ..... 97201349

[51] Int. Cl.[6] ..... H01K 1/46

[52] U.S. Cl. ..... 313/318.09; 313/318.01; 313/318.05; 439/611

[58] Field of Search ..... 313/318.01, 318.09, 313/318.1, 318.11, 318.05; 439/611, 616, 617, 618, 619; 362/516, 519, 226

[56] References Cited

U.S. PATENT DOCUMENTS 3,465,197 9/1969 Martin .

4,547,840 10/1985 Tinder ..... 362/226

5,115,381 5/1992 Van Heeswijk ..... 362/519

FOREIGN PATENT DOCUMENTS 1034268 12/1958 Germany .

*Primary Examiner*—Nimeshkumar D. Patel

*Attorney, Agent, or Firm*—F. Brice Faller

[57] ABSTRACT

The capped electric lamp has a glass bulb (1) having an opening (3) which is sealed with an insulator plate (4). The lamp cap (20) has a circumferential wall (22) which seizes about a circumferential rim (7) of the plate (4) and presses the plate (4) against an abutment (24) in the cap (20). Thereby, an electric element (9) in the bulb (1) which is mounted in a predetermined position with respect to the plate (4), has a predetermined position with respect to references (25) at the cap (1).

9 Claims, 2 Drawing Sheets

CAPPED ELECTRIC LAMP

BACKGROUND OF THE INVENTION

The invention relates to a capped electric lamp of the type having a glass bulb closed off by the first surface of an insulating plate having a second surface carrying a lamp cap with contacts connected to current conductors in the bulb.

Such a capped electric lamp is known from DE-B-1 034 268.

In the known lamp, the plate of insulating material is a profiled circular disc moulded from glass or synthetic resin. The first surface of the projecting edge of the plate facing the bulb has a first, comparatively wide annular portion and a second, comparatively narrow annular portion, with which portions the lamp can lie against the respective edges of a wide and of a narrow opening of the reflector when the lamp is placed in this reflector. The electric element, an incandescent body in the known lamp, has a predetermined position relative to said portions. It is achieved thereby that the electric element will occupy a predetermined position relative to the reflector.

A hollow cylindrical lamp cap is fixed to a side of the plate facing away from the bulb in a manner not described, from which lamp cap axially directed contacts, over which respective connectors can be passed, issue to the exterior. The lamp cap has the purpose of protecting the connections between the contacts and the current conductors.

The known lamp is accordingly designed for being brought against a mounting location with its bulb forward and for being retained there by additional means. It is desirable in many applications, however, to have a lamp available which can be placed with its lamp cap forward against a carrier, whereupon the electric element will occupy a predetermined position relative to this carrier.

In the known lamp, the connections between the current conductors and the contacts are indeed surrounded by the lamp cap and protected thereby, but forces are still exerted on the connector when the latter is being put into place, which may lead to damage.

U.S. Pat. No. 4,547,840 discloses a tubular electric lamp which is fastened with its current conductors to conductor tracks of a printed circuit. The lamp is accommodated in a cylindrical holder which grips with hooks through openings in the printed circuit board and supports the lamp mechanically. The electric element of the lamp, however, has an undefined position relative to the printed circuit board.

U.S. Pat. No. 3,456,197 discloses a tubular electric lamp which is fastened with its current conductors to contact pins which enter openings in a printed circuit and are fastened therein. The lamp is accommodated in a cylindrical holder which is retained against the printed circuit by the contacts. The electric element of this lamp, again, has an undefined position relative to the printed circuit board.

SUMMARY OF THE INVENTION

According to the invention, the lamp cap has a circumferential, axially directed wall which surrounds the projecting edge of the plate and which presses with its free-end portion against the first surface so as to keep the second surface pressed against an abutment in the lamp cap in axial direction, such that the electric element occupies a predetermined position relative to reference locations at an outer surface of the lamp cap.

During the manufacture of the lamp according to the invention, the electric element is mounted in a predetermined position relative to the plate of insulating material, preferably relative to the second surface of the plate, because variations in the axial dimension of the plate are eliminated thereby. When the lamp cap is subsequently provided and the second surface of the plate is pressed home against the abutment, the electric element will come to occupy a predetermined position relative to reference locations at the lamp cap.

The free-end portion of the wall of the lamp cap may be, for example, flanged inwards, for example in the cold state in the case of a metal wall or, for example, after heating in the case of a synthetic-resin wall. It is favorable, however, when the free-end portion presses against the first surface with studs which are directed towards the axis. The bulb may then be easily and quickly pressed up to the abutment in the lamp cap with the plate in front so as to assemble it together with the lamp cap.

It is favorable for a narrow fit and nevertheless easy mounting when the plate widens from the second surface to the first. The plate will then have a self-locating function during mounting of the lamp cap.

In a favorable embodiment, the plate has an unround circumference, and the axially directed wall has a corresponding shape in cross-section. The circumference may be, for example, oval, or circular with a flat side, or circular with mutually opposed flat sides. An unround shape has the advantage that the connection to the lamp cap is locked against rotation of the plate. Furthermore, an unround shape may define the locations where the current conductors are present, and the relative rotational positions of the plate and the lamp cap may be adjusted beforehand. The outside of the wall may also indicate the positions of the current conductors in that case, so that the lamp can be applied against a carrier in the desired rotational position. An unround shape thus facilitates the mechanized assembly of the lamp and the mechanized mounting of the lamp against a carrier.

It is favorable when the lamp cap is made entirely of synthetic resin. It is possible then to give the lamp cap a high dimensional accuracy and at the same time comparatively small dimensions, for example, a greatest transverse dimension of some ten millimeters and, for example, half that dimension in axial direction. The lamp cap need then add little to the axial dimension of the bulb with the plate, also partly on account of the recessed placement of the plate in the lamp cap. Another advantage of a synthetic-resin lamp cap is that synthetic resin is a comparatively bad heat conductor, so that there will be a temperature gradient in axial direction during lamp operation. A carrier against which the lamp cap is mounted may accordingly be manufactured from a material with a comparatively low heat resistance.

In a favorable embodiment, the synthetic-resin lamp cap contacts are anchored to the lamp cap. The lamp cap may have cavities extending transversely to the axis, for example radially, in which contact strips are accommodated. The contact strips may project from the lamp cap, for example radially. The contact strips may be secured to contacts of a carrier, for example of a printed circuit, through welding or soldering. If so desired, the contact strips may be provided with barbed hooks so that they can be easily inserted into the cavities, but cannot be removed therefrom. The current conductors may be, for example, welded or soldered to the contacts, or alternatively they may be held clamped against the contacts by the lamp cap.

The lamp cap may have reference locations at a transverse outer surface facing away from the bulb, for example in the form of elevations in a spatial distribution, relative to which the electric element is positioned. Instead, or in addition, the lamp cap may have a radially extending circumferential widened portion, possibly with interruptions, which serves as an abutment in the case of recessed mounting to a carrier.

The lamp cap may be made, for example, from polyether imide, polyether sulphon, polyphenylene sulphide, polybutylene terephthalate, etc., depending on the thermal load caused by lamp operation. The synthetic resin may be charged with, for example, glass fibers or glass powder.

The electric element of the lamp may be, a pair of electrodes in an ionizable medium, or an incandescent body in a gas which may comprise halogen. It will be favorable in general to position the electric element axially, especially coaxially with the bulb.

The electric lamp according to the invention is suitable, for example, for use as a lamp at the rear of vehicles, for example as a brake light lamp, indicator light lamp, rear light lamp, reversing light lamp, fog rear light lamp, etc. The lamp has the advantage that it can have a comparatively small axial dimension of approximately 2.5 cm and yet can dissipate comparatively high powers of, for example, 5 to 25 W. The housing in which the lamp is to be accommodated can be comparatively flat thanks to the comparatively small axial dimension.

BRIEF DESCRIPTION OF THE DRAWINGS

Embodiments of the capped electric lamp according to the invention are shown in the drawing, in which.

DETAILED DESCRIPTION OF THE PREFERRED EMBODIMENTS

Figure 1:
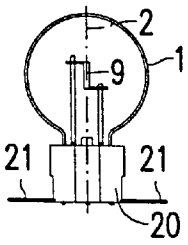
FIG. 1 shows the capped lamp in side elevation.
Figure 2:
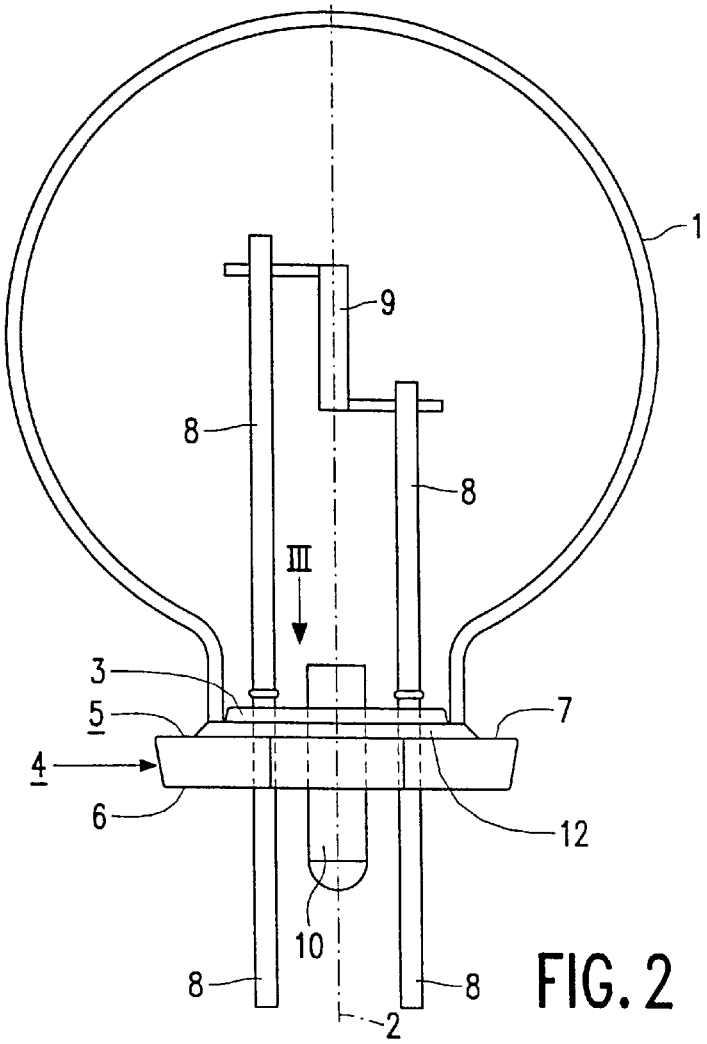
FIG. 2 shows the lamp of FIG. 1 without lamp cap in side elevation on an enlarged scale.

The capped electric lamp of FIG. 1, see also FIG. 2, is provided with a glass bulb 1 having an axis 2 and an opening 3 on the axis 2. The bulb has a neck-shaped portion adjacent the opening 3. A plate 4 of insulating material, which has a first surface 5 facing the bulb 1 and a second surface 6 facing away from the bulb 1, is present transverse to the axis 2. The plate 4 shown is made of sintered glass having the same composition as the glass of the bulb 1. The plate 4 is connected to the bulb 1 at its first surface 5 facing the bulb 1, by means of an enamal 12 in FIG. 2, sealing off the opening 3 in a gastight manner. The plate 4 has an edge 7 around the axis 2 which extends to outside the bulb 1. In FIG. 2, the lamp has a tipped exhaust tube 10 through which the lamp was provided with a gas filling. Current conductors 8 extend through the plate 4 into the interior of the bulb 1. They are connected to an electric element 9, an incandescent body in FIGS. 1 and 2, which is arranged in the bulb 1 in a predetermined position relative to the plate 4. The incandescent body dissipates a power of 16 W when operated at 13.5 V. The lamp in FIG. 1 has a lamp cap 20 provided with contacts 21 which are connected to the current conductors 8 and which are fixed against the second surface 6 of the plate 4, cf. FIG. 2.

Figure 4:
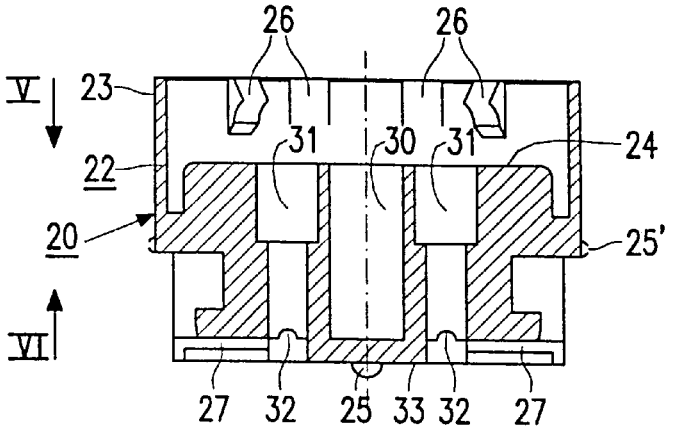
FIG. 4 shows the lamp cap of FIG. 1 in an axial sectional view, on an enlarged scale.
Figure 5:
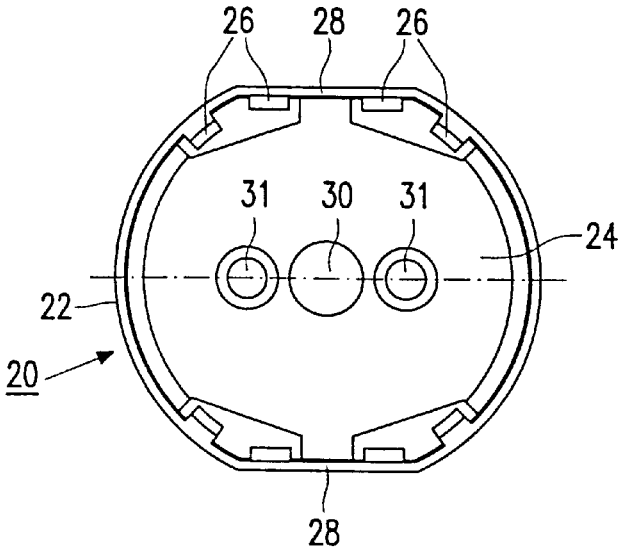
FIG. 5 is an elevation of the lamp cap viewed along the line V in FIG. 4.

The lamp cap 20, see FIGS. 4 and 5, has a circumferential, axially directed wall 22 which surrounds the projecting edge 7 of the plate 4 and which presses with its free-end portion 23 against the first surface 5 so as to keep the second surface 6 of the plate 4 pressed against an abutment 24 in the lamp cap 20 in axial direction. The electric element 9 as a result occupies a predetermined position relative to reference locations 25, see FIGS. 4 and 6, at a transverse outer surface 33 of the lamp cap 20.

Figure 3:
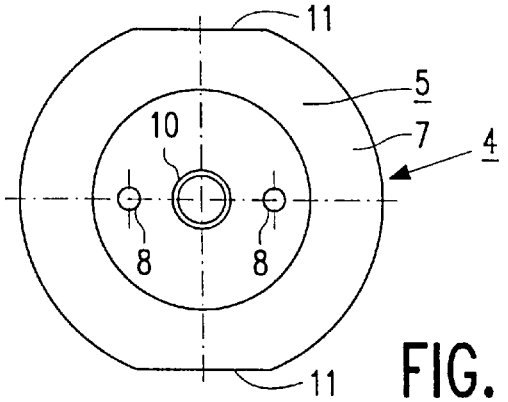
FIG. 3 shows the plate viewed along the line III in FIG. 2.

The plate 4, see FIG. 3, has an unround circumference, being circular with two mutually opposed flat sides 11 in the Figure. The axially directed wall 22 of the lamp cap 20 has a corresponding shape in transverse cross-section, see FIG. 5, i.e. circular with two mutually opposed flat sides 28.

The free-end portion 23 of the axially directed wall 22, see FIGS. 4 and 5, presses with studs 26 directed towards the axis 2 against the first surface 5 of the plate 4. The plate 4 narrowly fits with its flat sides 11 between the flat sides 28, but its circular circumference portions it lie with some small clearance between the circular portions of the wall 22. The studs 26, see also FIG. 5, at these circular portions project to the inside in locations farther away from the free-end portion 23 than do the studs 26 at the flat sides 28. They are close to the flat sides 28, and as a result the circular portions of the wall 22, which may also have interruptions, if so desired, can spring largely inwards when the lamp is being inserted, while the studs 26 move in outward direction so as to allow the plate 4 to pass. The studs 26 force the second surface 6 of the plate 4, see FIG. 2, against the abutment 24 of the lamp cap 20. The electric element 9 thus has a predetermined position relative to the reference locations 25. The abutment 24 and the axially directed wall 22 together bound a cavity in which the plate 4 is recessed. The flat sides 28 are visible at the outside of the lamp cap 20, merging into flat outer surfaces 29 over the axial dimension of the lamp cap 20. The lamp cap 20 has a cavity 30 for an exhaust tube 10 of the lamp, see FIG. 2, and channels 31 for the current conductors 8. The flat sides 28 and the flat outer surfaces 29 betray the positions of these channels 31, and thus the positions of the current conductors 8 in the assembled lamp.

The plate 4 widens from the second surface 6 to the first surface 5, see FIG. 2.

Figure 6:
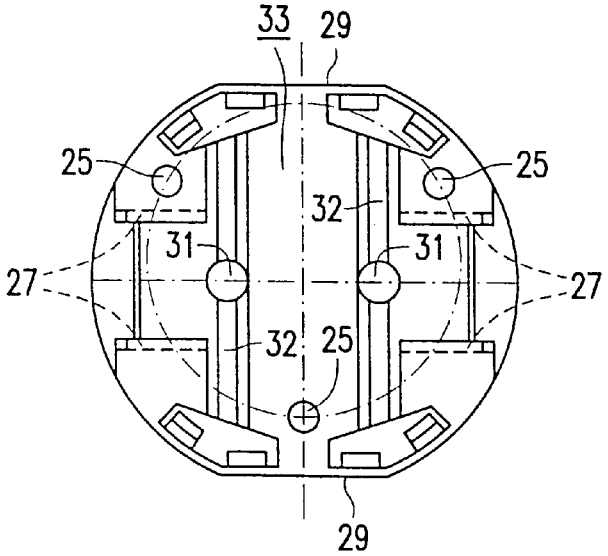
FIG. 6 is an elevation of the lamp cap viewed along the line VI in FIG. 4.

The lamp cap 20 is entirely made of synthetic resin and has cavities 27 extending transversely to the axis 2, see FIGS. 4 and 6, in which cavities strip-shaped contacts 21 are accommodated, as shown in FIG. 1.

In the embodiment shown, the lamp cap 20 has grooves 32 into which the current conductors 8 can be bent upon issuing from the channels 31. When the contacts 21 are subsequently passed into the cavities 27 over the current conductors 8, they will have a clamp connection therewith. In FIG. 1, the contacts 21 project laterally from the lamp cap 20. Alternatively, however, they may lie entirely within the boundaries of the lamp cap 20, for example if they are to be soldered to a carrier, for example a printed circuit.

The channels 31 for the current conductors 8 each have a narrowed portion in FIG. 4. Contacts, for example hollow pins, may be accommodated in the channels, for example with clamping force, and may issue from the channels 31 to the exterior, abutting each with a portion thereof against the narrowed portion. The contacts are then securely anchored in the lamp cap so as to serve as fastenings to a carrier at the same time.

The reference locations 25 relative to which the electric element 9 has a predetermined position are bulges on the lamp cap 20 in FIGS. 1, 4, and 6. FIG. 4 shows a circumferential edge 25' which may serve as an alternative to this.

We claim:

1. A capped electric lamp provided with:

a glass bulb (1) having an axis (2) and an opening (3) on said axis (2);

a plate (4) of insulating material arranged transversely to said axis (2) and having a first surface (5) facing the bulb (1) and a second surface (6) facing away from the bulb (1), which plate (4) is connected to the bulb (1) by its first surface (5), sealing the opening (3) in a gastight manner, and has an edge (7) around the axis (2) projecting to outside the bulb (1);

current conductors (8) passed through the plate (4) into the interior of the bulb (1);

an electric element (9) arranged in the bulb (1) in a predetermined position relative to the plate (4)and connected to the current conductors (8); and a lamp cap (20) which is provided with contacts (21) connected to the current conductors (8) and which is fixed against the second surface (6) of the plate (4), characterized in that the lamp cap (20) has a circumferential, axially directed wall (22) which surrounds the projecting edge (7) of the plate (4) and which presses with its free-end portion (23) against the first surface (5) so as to keep the second surface (6) pressed against an abutment (24) in the lamp cap (20) in axial direction, such that the electric element (9) occupies a predetermined position relative to reference locations (25) at an outer surface of the lamp cap (20).

2. A capped electric lamp as claimed in claim 1, characterized in that the plate (4) has an unround circumference, and the axially directed wall (22) has a corresponding shape in transverse cross-section.

3. A capped electric lamp as claimed in claim 1 wherein the free-end portion (23) presses against the first surface (5) with studs (26) which are directed towards the axis (2).

4. A capped electric lamp as claimed in claim 3, characterized in that the plate (4) widens in a direction from the second surface (6) to the first surface (5).

5. A capped electric lamp as claimed in claim 1 wherein the lamp cap (20) is made entirely of synthetic resin.

6. A capped electric lamp as claimed in claim 5, characterized in that the lamp cap (20) has cavities (27) extending transversely to the axis (2), in which cavities (27) strip-shaped contacts (21) are accommodated.

7. A capped electric lamp as claimed in claim 6, characterized in that the contacts (21) have a clamped connection to the current conductors (8).

8. A capped electric lamp as claimed in claim 6 wherein the contacts (21) project laterally from the lamp cap (20).

9. A capped electric lamp comprising a glass bulb having an axis and an opening on said axis;

a plate of insulating material arranged transversely to said axis and having a first surface facing the bulb and a second surface facing away from the bulb, said plate being connected to the bulb by its first surface, sealing the opening in a gastight manner, and having an edge around the axis projecting to outside the bulb;

current conductors passing through the plate into the interior of the bulb;

an electric element arranged in the bulb in a predetermined position relative to the plate and connected to the current conductors; and a lamp cap provided with contacts connected to the current conductors and comprising an abutment fixed against the second surface of the plate, the lamp cap further comprising a circumferential, axially directed wall surrounding the projecting edge of the plate and a free-end portion pressing against the first surface so as to keep the second surface pressed against the abutment in the lamp cap, whereby the electric element occupies a predetermined position relative to the lamp cap.

* * * * *